US007845019B2

(12) United States Patent
Bowen et al.

(10) Patent No.: US 7,845,019 B2
(45) Date of Patent: Dec. 7, 2010

(54) SYSTEMS AND METHODS FOR PROVIDING INFLATABLE APPAREL

(75) Inventors: Thomas K. Bowen, Provo, UT (US); Anne Fairchild, Provo, UT (US)

(73) Assignee: BRT, LLP, Provo, UT (US)

( * ) Notice: Subject to any disclaimer, the term of this patent is extended or adjusted under 35 U.S.C. 154(b) by 5 days.

(21) Appl. No.: 12/102,788

(22) Filed: Apr. 14, 2008

(65) Prior Publication Data

US 2008/0307557 A1 Dec. 18, 2008

Related U.S. Application Data

(60) Provisional application No. 60/923,279, filed on Apr. 13, 2007.

(51) Int. Cl.
*A41D 25/00* (2006.01)

(52) U.S. Cl. ..... 2/144

(58) Field of Classification Search ..... 2/69, 2/102, 170, 171, 144, 456, 108, DIG. 3
See application file for complete search history.

(56) References Cited

U.S. PATENT DOCUMENTS 5,303,425 A * 4/1994 Mele ..... 2/115
5,325,539 A * 7/1994 Kronenberger ..... 2/195.2
5,402,535 A * 4/1995 Green ..... 2/468
5,551,084 A * 9/1996 Freese, III ..... 2/23
5,893,175 A * 4/1999 Cooper ..... 2/462
6,564,387 B1 * 5/2003 Willoughby ..... 2/69
7,392,549 B1 * 7/2008 Barber ..... 2/86

* cited by examiner

*Primary Examiner*—Tejash Patel
(74) *Attorney, Agent, or Firm*—David B. Tingey; Kirton & McConkie

(57) ABSTRACT

This application relates to inflatable apparel. In particular, this application discusses systems and methods for providing apparel that is both selectively inflatable and adapted for use as a pillow. The inflatable apparel may include any clothing or object that is adapted to be worn by a person and is selectively inflatable so as to act a cushion for the person wearing the apparel or of another. The inflatable apparel comprises an apparel item, such as a necktie, and an inflatable bladder. In some cases, the necktie is made to receive and retain the bladder in an inflated position or a deflated position. The bladder extends through at least a portion of the necktie. Additionally, when inflated, the bladder provides a pillow or cushion for use by the individual wearing the inflated necktie, or for use by an individual other than the person wearing the necktie.

17 Claims, 8 Drawing Sheets

SYSTEMS AND METHODS FOR PROVIDING INFLATABLE APPAREL

RELATED APPLICATIONS

This application claims priority to U.S. Provisional Patent Application Ser. No. 60/923,279, entitled "SYSTEMS AND METHODS FOR PROVIDING AN INFLATABLE NECKTIE," filed Apr. 13, 2007, which is hereby incorporated by reference.

BACKGROUND OF THE INVENTION

1. Field of the Invention

This disclosure relates to inflatable apparel and/or accessories. In particular, this disclosure discusses systems and methods for providing apparel and/or accessories that are selectively inflatable, and can be adapted for use as a pillow.

2. Background and Related Art

Pillows are often used to support a person's head during sleep or rest. As is generally known, pillows typically comprise a bag or case made of cloth that is filled with feathers, down, cotton, batting, or another soft material.

Some pillows are adapted for use as travel pillows. However, some travel pillows can be bulky and cumbersome, even when compacted for storage. Accordingly, such pillows may require undesirable amounts of space in luggage, pockets, bags, and the like. As a result, such pillows may increase the size of a person's load or prevent the person from bringing additional items.

Some travel pillows can be just another object that a person has to remember to pack. Thus, a person can easily forget to bring such pillows. Consequently, such a person may be prevented from resting as desired or may be forced to rest on an uncomfortable support, such as a piece of luggage, a back side of an adjacent chair, a wall, etc.

Some travel pillows may call unwanted attention or be inappropriate for certain occasions. For instance, a person may feel uncomfortable bringing a pillow to a business meeting, a church service, or artistic performance, such as the symphony. Conversely, in yet another example, some travel pillows are common place and do not call desired attention to the person using the pillow.

Thus, while techniques currently exist that are used to support a person's head where full-sized bed pillows are inappropriate, challenges still exist. Accordingly, it would be an improvement in the art to augment or even replace current techniques and apparatus with other techniques and apparatus.

SUMMARY OF THE INVENTION

This disclosure relates to inflatable apparel and/or accessories. In particular, this disclosure discusses systems and methods for providing apparel and/or accessories that are selectively inflatable, and can be adapted for use as a pillow.

The inflatable apparel may include any clothing or object that is adapted to be worn by a person and is selectively inflatable so as to act a cushion that can support a body member, including a head, neck, face, etc., of either the person wearing the apparel or of another. Some non-limiting examples of such apparel may include neckties, ascots, scarves, turtle-neck collars, jacket lapels, shirt and coat collars, coat and jacket hoods, stocking caps, hats, head bands, wrist bands, shirt cuffs, braziers, underwear, or any other apparel that can be selectively inflatable for use as a cushion or pillow.

Some implementations of the present invention take place in association with a necktie that includes a mechanism or system that allows at least a portion of the necktie to be selectively inflated. In some implementations, the necktie itself is selectively inflated. In other implementations, a bladder is configured to be received by or otherwise coupled to the necktie.

In some instances, an inflatable bladder is provided that extends throughout at least a portion of the necktie. While the bladder is inflatable to provide a pillow or cushion to be used by the individual wearing the inflated necktie, the inflated necktie can also provide a pillow or cushion to an another individual. For instance, a first person wearing the necktie can place the inflated necktie on his shoulder so that another person can rest her head on the inflated necktie.

Although, in some cases, the bladder is integrally connected within the necktie. In other cases, the bladder is selectively removable from the necktie. Where the bladder is selectively removable from the necktie, the bladder may be interchanged between a plurality of neckties.

While the methods and processes of the present invention have proven to be particularly useful in the area of inflatable apparel, such as neckties, those skilled in the art can appreciate that the methods and processes can be used in a variety of different applications to yield inflatable items that are typically carried by a person. Some non-limiting examples of such items include purses, wallets, or any other item that is typically carried by a person and that can be inflated.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

This disclosure relates to inflatable apparel and/or accessories. In particular, this disclosure discusses systems and methods for providing apparel and/or accessories that are selectively inflatable, and can be adapted for use as a pillow.

Figure 1:
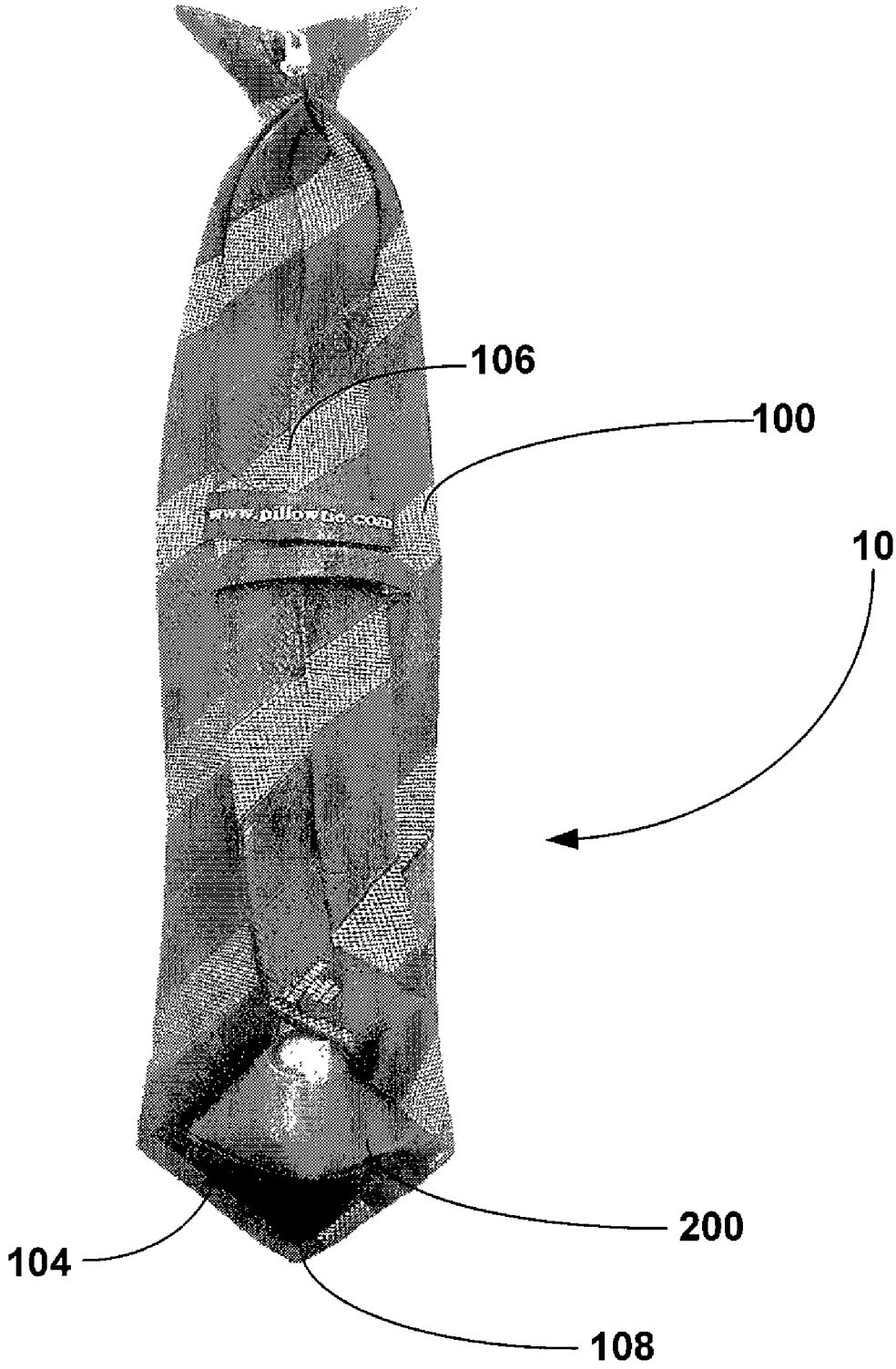
FIG. 1 illustrates a back view of a representative inflatable necktie in accordance with an embodiment of the present invention.

Although the described inflatable apparel can comprise any component that allows it to be worn and selectively inflatable, FIG. 1 shows some embodiments where the inflatable apparel 10 comprises an item of apparel (e.g., necktie 100) and an inflatable bladder 200. To provide a better understanding of the inflatable apparel, the apparel item and the bladder are discussed below in more detail.

With reference to the apparel item, the apparel item may include any piece of clothing or object that is adapted to be worn by a person and that can be selectively inflatable so as to act a cushion or support for a body member (e.g., the head, neck, face, back, shoulder, arm, etc.) of either the person wearing the apparel or of another. Some non-limiting examples of such apparel items may include neckties, ascots, scarves, turtle-neck collars, jacket lapels, shirt and coat collars, coat and jacket hoods, stocking caps, hats, head bands, wrist bands, shirt cuffs, braziers, underwear, or any other apparel that can be selectively inflatable for use as a pillow.

Figure 2:
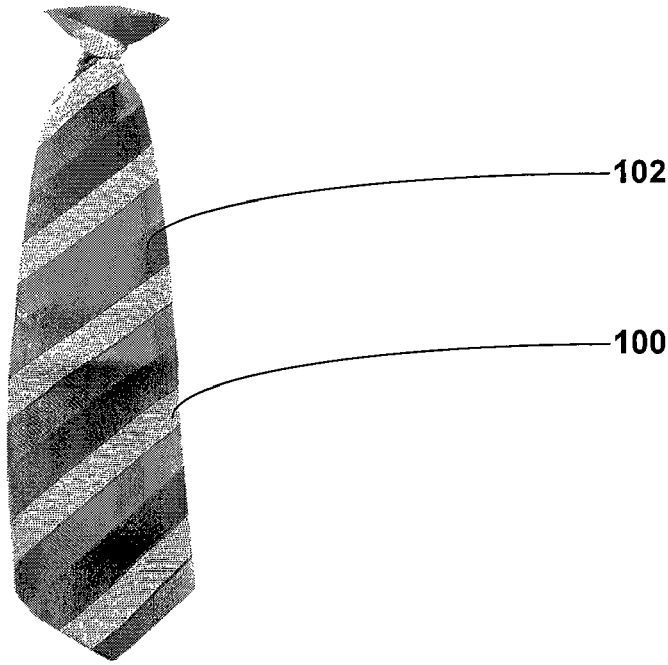
FIG. 2 illustrates a front view of a representative necktie in accordance with an embodiment of the present invention.
Figure 3:
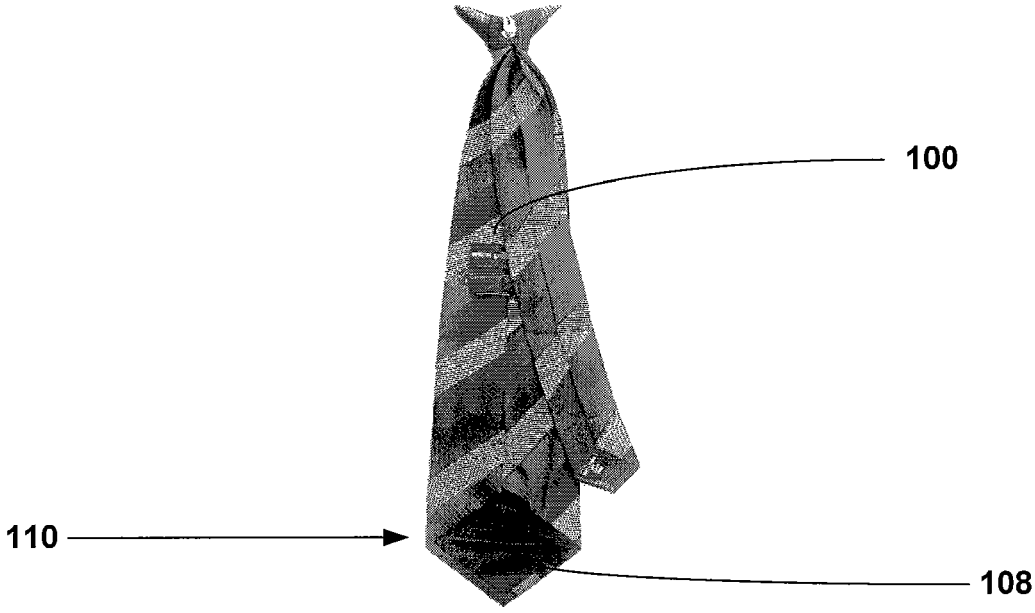
FIG. 3 illustrates a back view of representative necktie that is configured to receive a bladder.

In some embodiments, the apparel item comprises a necktie. In such embodiments, the inflatable apparel may be appropriate in virtually any place in which a tie is appropriate. Where the apparel item comprises a necktie, the necktie can comprise any known or novel necktie, including a four-in-hand necktie, a six-fold tie, a seven-fold tie, a zipper tie, a clip-on tie, and the like. By way of illustration, FIGS. 2 and 3 show a representative necktie 100. Specifically, FIG. 1 illustrates a front view of a clip-on necktie 100 and FIG. 2 illustrates a back view of the necktie 100.

The necktie can comprise any characteristic or component that allows it to be worn around a person's neck and as well as to be inflated. In some embodiments, the necktie 100 comprises an outer material 102 (shown in FIG. 2) and an inner lining (not shown). The outer material of the necktie may be made of any material suitable for use in a necktie. For example, the outer material can comprise silk, polyester (i.e., microfiber), cotton, wool, and/or another suitable material.

In at least some embodiments, the necktie includes a receiving portion that is configured to receive the bladder. In such embodiments, the receiving portion can comprise any component that allows the necktie to perform the described purposes. For example, the receiving portion can include an enclosure, a cavity, a covering, a pocket, an internal space, and/or chamber that is configured to receive a bladder or otherwise receive air for the inflation of the necktie. By way of illustration, FIG. 1 shows some embodiments where a portion of the necktie 100 comprises an internal space 104 that houses the bladder 200.

Where the necktie comprises an internal space, the internal space may be made in any manner that allows the space to house a bladder (e.g., bladder 200). For instance, while some conventional ties comprise a seam on the ties' backside that stitches the outer material to the inner lining, in some embodiments, the seam 106 on the backside of the necktie 100 does not connect the outer material to the inner lining, at least not for the length of the internal space. Accordingly, the internal space in the necktie can be separated so as to allow the bladder to be inserted and/or inflated within the necktie.

Figure 4:
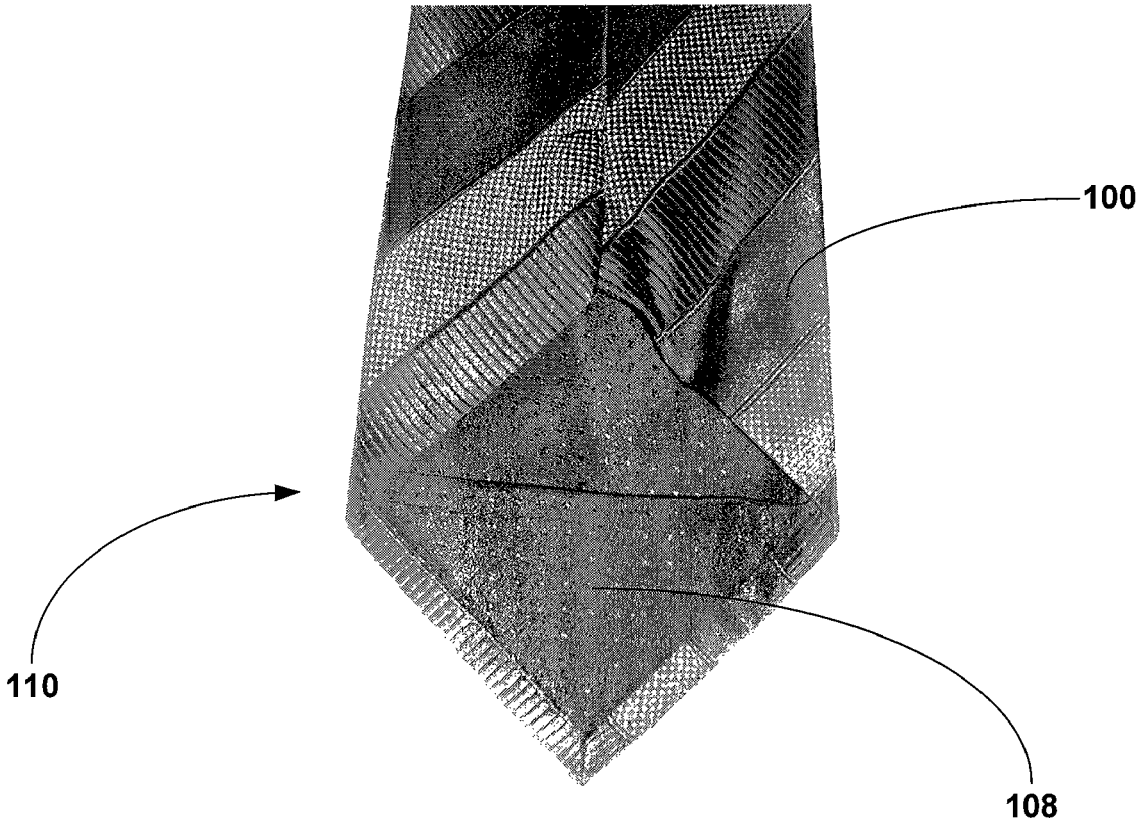
FIG. 4 illustrates a back view of a portion of representative necktie.

In some embodiments, the necktie includes a retaining mechanism that acts to selectively or permanently retain the bladder in the necktie. Any component that acts to retain the bladder in the necktie can act as the retaining mechanism. Some non-limiting examples of retaining mechanisms that permanently retain the bladder within the necktie can include a mechanical fastener (e.g., stitching) or a chemical fastener (e.g., an adhesive). Similarly, some examples of retaining mechanisms that selectively and releaseably retain the bladder in the necktie can include a flap, a hook and loop fastener, a snap, a button, a frictional engagement, and/or any other component adapted selectively retain the bladder in the necktie. In one example, FIG. 3 shows the retaining mechanism can comprise a flap 108 that is disposed on the backside of the broad portion 110 of the necktie 100 adjacent to the broadest portion of the necktie 100. In this example, FIGS. 1 and 4 shows the flap 108 can act as a sling to supports the bladder 200 and selectively retain it within the necktie 100.

Figure 5:
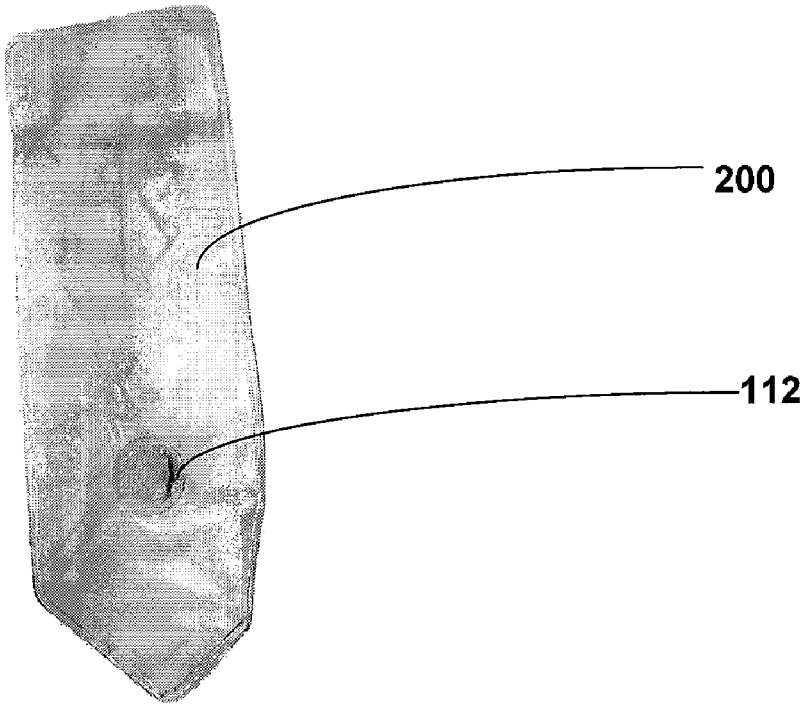
FIG. 5 illustrates a view of a representative inflatable bladder in accordance with an embodiment of the present invention, wherein the bladder is in a deflated position.

With reference now to the bladder, the described inflatable apparel comprises a bladder that allows the inflatable apparel to be selectively inflated and deflated. Such a bladder can include any component that allows the inflatable apparel to be inflated and deflated, as desired. For example, the bladder can comprise an a bag, an open-cell bladder, or other object that is configured to be selectively inflated and deflated. By way of illustration, FIG. 5 shows some embodiments where the bladder 200 comprises an inflatable bag, wherein the bladder 200 is shown in a deflated position.

Figure 6:
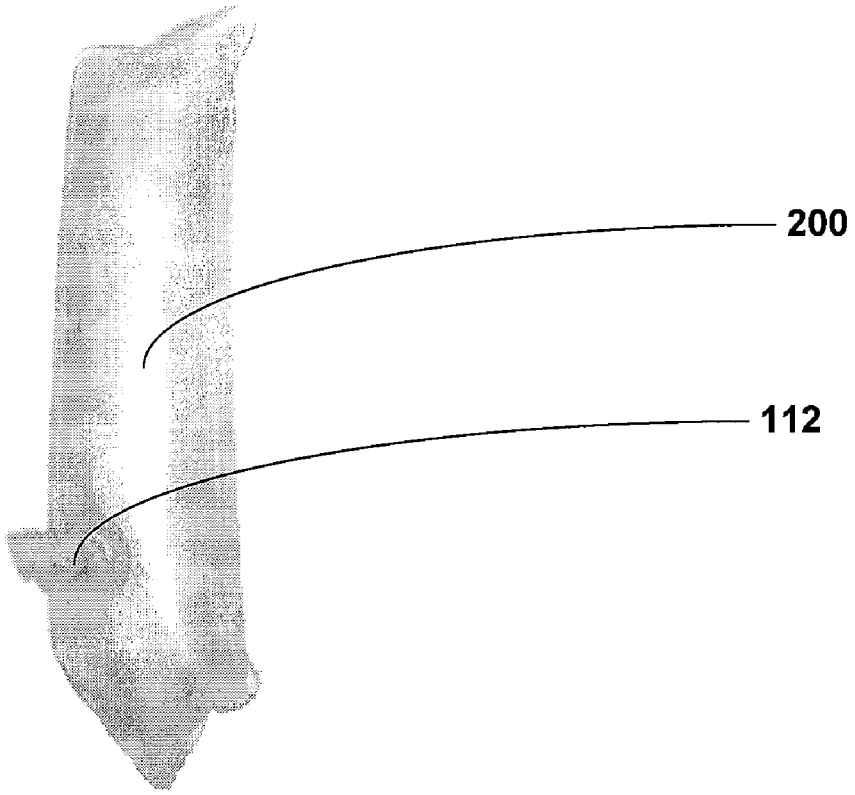
FIG. 6 illustrates a view of a representative inflatable bladder, wherein the bladder is in an inflated position.

In another example of suitable bladder characteristics, the bladder can be any shape or size that allows the bladder to inflate at least a portion of the apparel item (e.g., necktie 100). While the bladder can be adapted to inflate any desired portion of the necktie, FIGS. 5 and 6 show some embodiments where the bladder 200 is shaped and sized to extend through a fraction of the broad portion 110 of the necktie 100 so as to provide a pillow or cushion.

The bladder can be formed of any material that is suitable to inflate, deflate, and act as a cushion or pillow. For example, the bladder can be formed of one or more plastics, polymers, rubbers, microfibers, or another inflatable material. Moreover, the bladder can comprise multiple materials and or layers of materials. For instance, a first side of the bladder can comprise a polymer layer and a second side of the bladder can comprise a microfiber layer or a polymer layer coated with a microfiber layer. In such instances, the microfiber layer may act as a frictional engagement that serves to selectively retain the bladder within the necktie.

In some embodiments, the bladder comprises a valve that allows the bladder to be selectively inflated or deflated. In such embodiments, the bladder can include any suitable valve, including a plug-in-hole valve, a uni-directional valve, or a bi-directional valve. In one example, FIG. 6 shows a bladder 200 comprising a plug-in-hole valve 112. In this example, the plug-in-hole valve may be squeezed in order to allow gases to escape from the inflated bladder.

The bladder can be inflated in virtually any desired manner. For example, the bladder can be inflated manually, mechanically, or be self-inflated. Where the bladder is inflated manually, the bladder can be inflated in any suitable manner. In one example, the bladder could be filled by blowing air from one's mouth through the plug-in-hole valve 112. In another example, the bladder could be filled by blowing air through an elongated tube that is connected to the valve and/or bladder.

Where the bladder is inflated mechanically, the bladder can be inflated in any suitable manner. For example, the bladder can be filled through the use of a pump or a container filled with compressed gas (e.g., a $CO_2$ canister). In this example, any suitable pump or compressed gas container can be used to inflate the bladder, including a pump or container that is integrally formed with, or selectively attachable to, the bladder.

Where the bladder is adapted to be self inflated, it can have any characteristic or component that allows it to inflate itself. For example, the bladder can comprise an open cell bladder that is adapted to elastically expand and pull air into the bladder as well as to be compacted and force air from the bladder.

Figure 7:
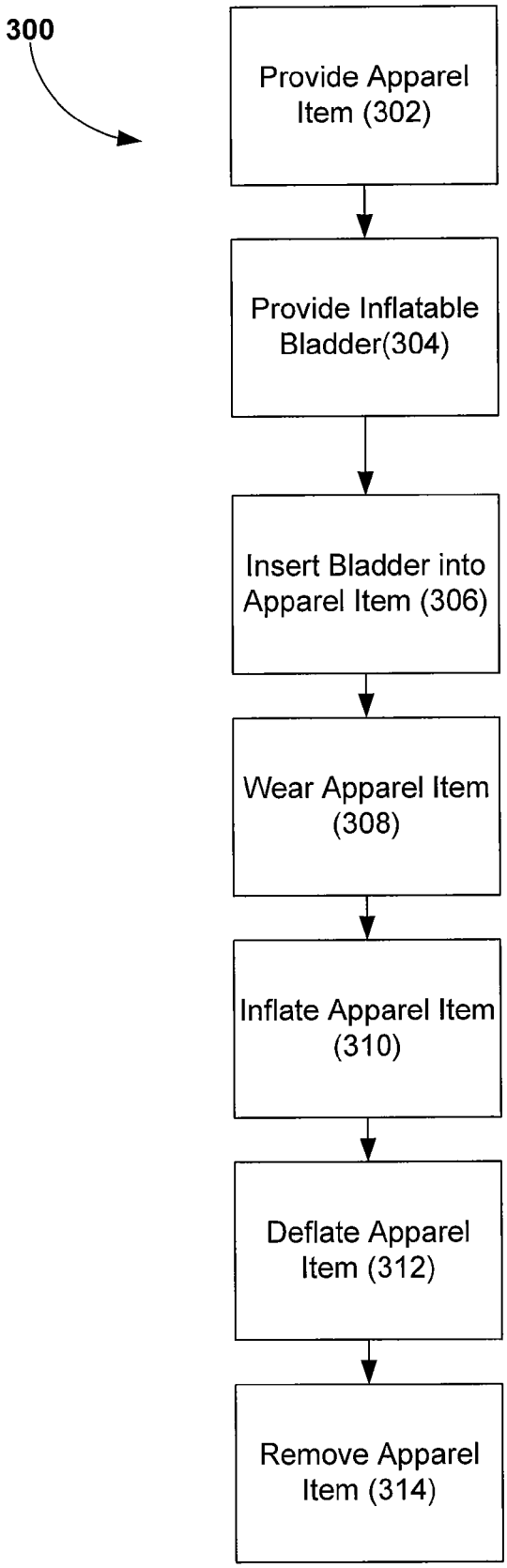
FIG. 7 illustrates one example of a method for using the describe inflatable necktie.
Figure 8:
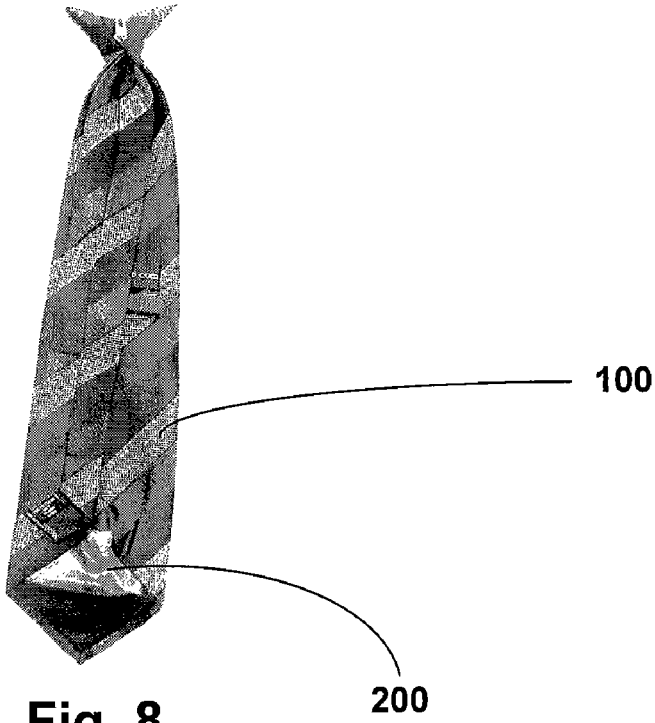
FIG. 8 illustrates a view of a representative inflatable bladder inserted into the necktie, wherein the bladder is in a deflated position.
Figure 9:
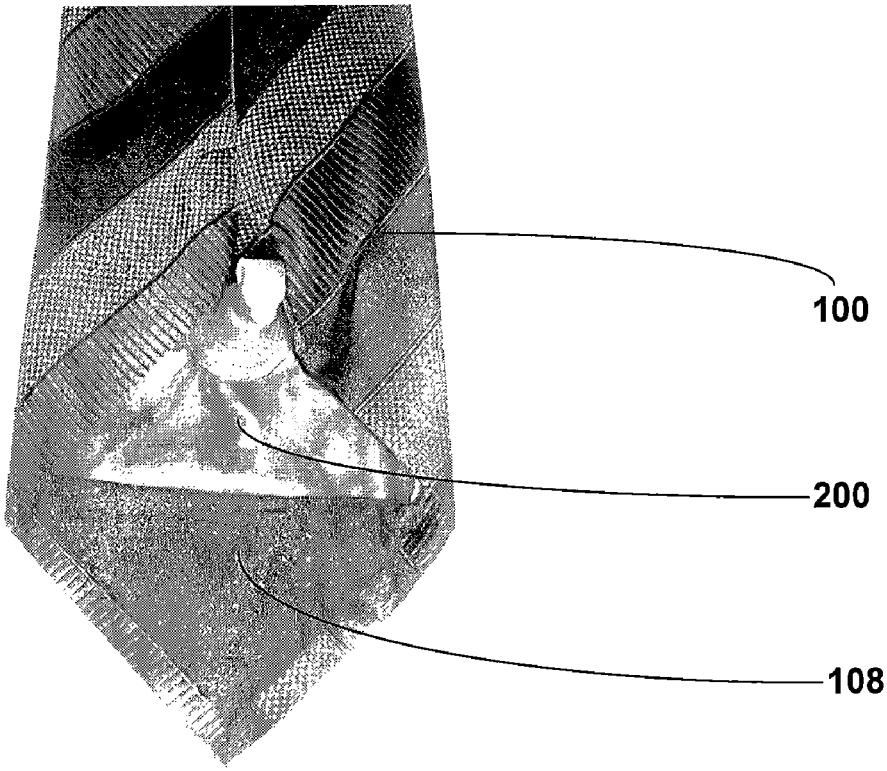
FIG. 9 illustrates another view of a representative inflatable bladder inserted into the necktie, wherein the bladder is in a deflated position.
Figure 10:
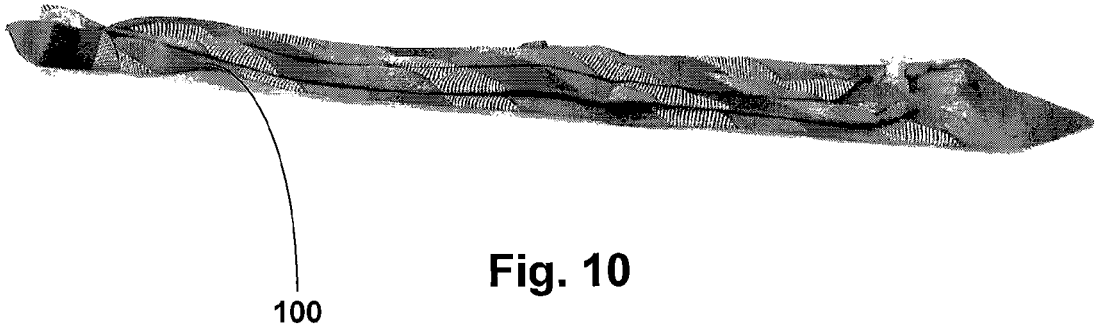
FIG. 10 illustrates a side view of a representative inflatable bladder inserted into the necktie, wherein the bladder is in a deflated position.
Figure 11:
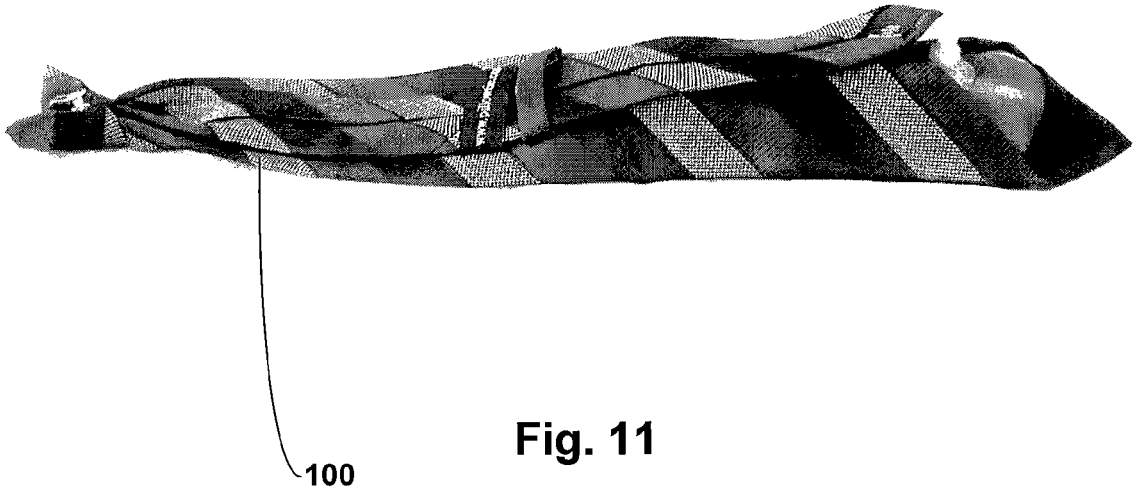
FIG. 11 illustrates a side view of a representative inflatable bladder in accordance with an embodiment of the present invention, wherein the bladder is in an inflated position.
Figure 12:
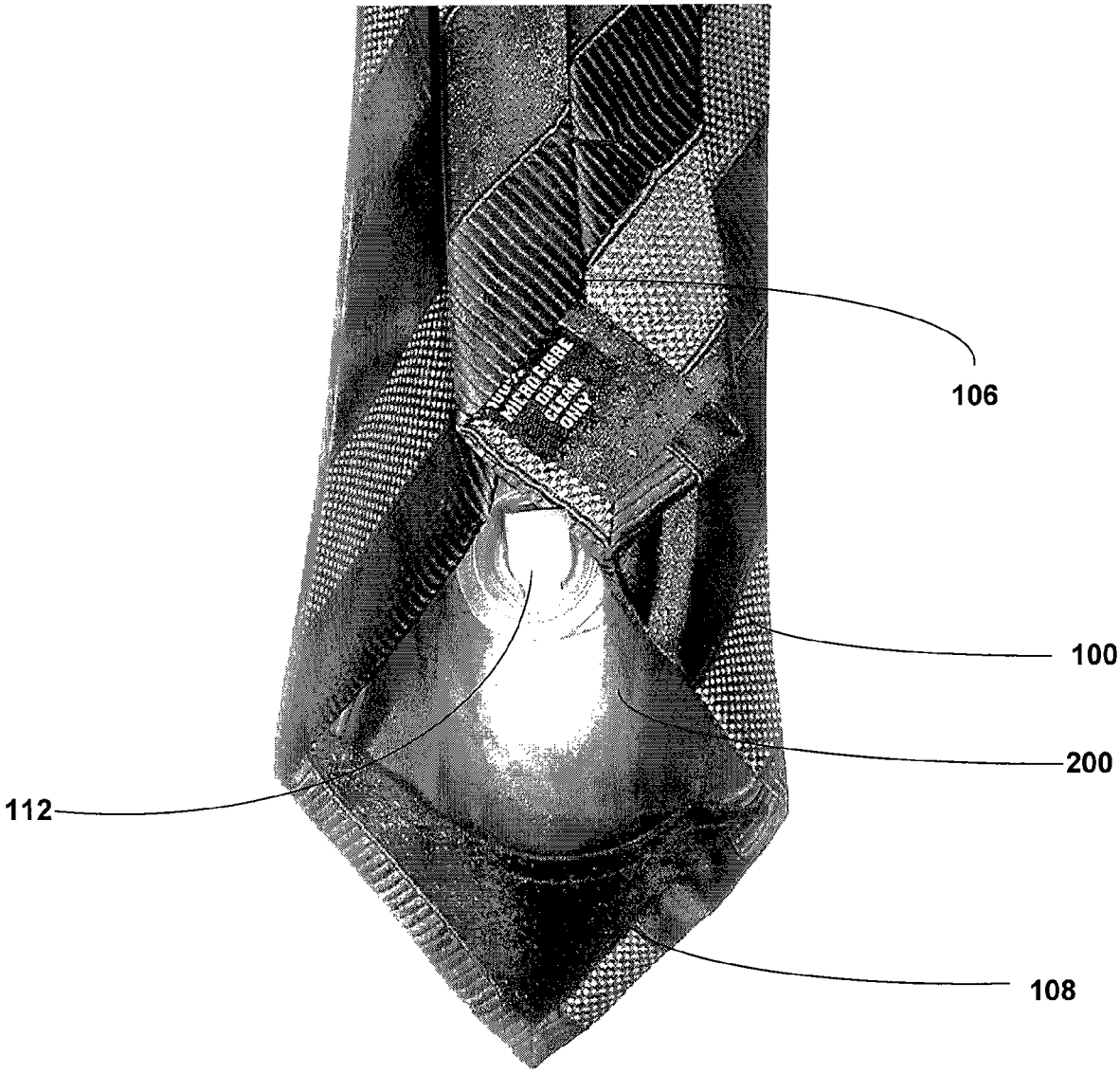
FIG. 12 illustrates a representative inflatable bladder inserted into the necktie, wherein the bladder is in an inflated position.

Although the described inflatable apparel can be used in suitable manner, for purposes of illustration, FIG. 7 shows a flowchart that illustrates a non-limiting example of a typical method of use. Specifically, FIG. 7 shows the method 300 begins at 302 by providing an apparel item, such as the necktie 100 shown in FIGS. 2 and 3. This method continues at 304 by providing the bladder 200 shown in FIG. 5. At 306, FIG. 7 shows the bladder 200 is inserted into the necktie as shown in FIGS. 8, 9, and 10. Next, at 308, FIG. 7 shows the necktie is worn by being placed on a person's neck. FIG. 7 at 310 shows the bladder and necktie can be inflated to an inflated position, as shown in FIGS. 1, 11, and 12, at any desired time. Once inflated, the necktie can be used as a pillow or cushion. After use, FIG. 7 at 312 shows the necktie can be deflated. FIG. 7 at 314 shows the necktie can be removed before the process is repeated.

In addition to the described systems, methods, characteristics, and embodiments, the inflatable apparel may be varied in any suitable manner. For example, as previously mentioned, the inflatable apparel can comprise a brazier. In this example, the brazier can comprise a bladder configured to be used in the brazier. Accordingly, the brazier can be inflated to accentuate the bust of the person wearing the brazier. In another example, the inflatable apparel can also comprise underwear with a corresponding bladder. In this example, the underwear can be adapted to be inflated in a manner that accentuates the bottom or genitalia of the person wearing underwear.

In addition to previously mentioned benefits, the described inflatable apparel may offer several benefits or advantages over non-inflatable apparel. In one previously mentioned example, the apparel may be selectively inflated to be used as a pillow or cushion. In another example, the apparel can also be deflated so as to appear as other non-inflatable apparel. In yet another example, the inflatable apparel does not require a person to bring an additional travel pillow or lose more space than is desired to storing the pillow. In still another example, the inflatable apparel, such as the inflatable necktie, brazier, or underwear, may be used as novelty item or gag.

Thus, as discussed herein, the embodiments of the present invention embrace inflatable apparel and accessories. In particular, this disclosure discusses systems and methods for providing apparel and accessories that are selectively inflatable, and can be adapted for use as a pillow. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An inflatable apparel system comprising:

an inflatable bladder having a configuration and a valve; and a necktie comprising:

a surface that defines a bladder receiving portion to selectively receive the inflatable bladder, wherein the bladder receiving portion has a configuration that corresponds to the configuration of the bladder; and a retaining mechanism to selectively and releaseably retain the bladder at the bladder receiving portion in a deflated position and in an inflated position, and wherein the retaining mechanism enables the selective removal of the bladder from the bladder receiving portion.

2. A necktie system comprising:

an inflatable bladder having a configuration and a valve; and a necktie comprising:

a surface that defines a bladder receiving portion to selectively receive the inflatable bladder, wherein the bladder receiving portion has a configuration that corresponds to the configuration of the bladder; and a retaining mechanism to selectively and releaseably retain the bladder at the bladder receiving portion in a deflated position and in an inflated position, and wherein the retaining mechanism enables the selective removal of the bladder from the bladder receiving portion.

3. The necktie system of claim 2, wherein the valve comprises a plug-in-hole valve.

4. The necktie system of claim 2, further comprising a pump that is integrally connected to the bladder.

5. The necktie system of claim 2, wherein the necktie further comprises an inner liner and an outer material, wherein the outer material comprises a seam disposed on a backside of the necktie, and wherein the seam is not stitched to the lining throughout the receiving portion.

6. The necktie system of claim 2, wherein the retaining mechanism comprises a flap disposed adjacent to a broadest portion of the necktie.

7. The necktie system of claim 2, wherein the retaining mechanism comprises microfiber on at least one side of the bladder.

8. The necktie system of claim 2, further comprising an elongated tube that is connected to the bladder and is adapted to pass air from a person's mouth to the bladder.

9. A method for making an inflatable necktie system, the method comprising:

providing an inflatable bladder having a configuration and a valve; and providing the inflatable bladder for selective coupling to a bladder receiving portion of a necktie, the necktie comprising:

a surface that defines the bladder receiving portion to selectively receive the inflatable bladder, wherein the bladder receiving portion has a configuration that corresponds to the configuration of the bladder; and a retaining mechanism to selectively retain the bladder at the bladder receiving portion in a deflated position and in an inflated position, and wherein the retaining mechanism enables the selective removal of the bladder from the bladder receiving portion.

10. The method of claim 9, further comprising inserting the bladder into the receiving portion.

11. The method of claim 9, wherein the valve comprises a plug-in- hole valve.

12. The method of claim 9, further comprising a pump that is integrally connected to the bladder.

13. The method of claim 9, wherein the necktie further comprises an inner liner and an outer material, wherein the outer material comprises a seam disposed on a backside of the necktie, and wherein the seam is not stitched to the lining throughout the receiving portion.

14. The method of claim 9, wherein the retaining mechanism comprises a flap disposed adjacent to a broadest portion of the necktie.

15. The method of claim 9, wherein the retaining mechanism comprises microfiber on at least one side of the bladder.

16. The method of claim 9, further comprising providing an elongated tube that is connected to the bladder and is adapted to pass air from a person's mouth to the bladder.

17. A necktie system comprising:

a first necktie having a surface that defines a receiving portion to selectively receive an inflatable bladder;

a second necktie having a surface that defines a receiving portion to selectively receive an inflatable bladder; and an inflatable bladder that is selectively interchangeable between the receiving portions of the first and second neckties.

* * * * *